US009678467B2

(12) United States Patent
Maehara

(10) Patent No.: US 9,678,467 B2
(45) Date of Patent: Jun. 13, 2017

(54) DEVELOPER DETECTOR AND DEVELOPING DEVICE

(71) Applicant: Sharp Kabushiki Kaisha, Osaka (JP)

(72) Inventor: Hiroyoshi Maehara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 15/205,195

(22) Filed: Jul. 8, 2016

(65) Prior Publication Data

US 2017/0010577 A1 Jan. 12, 2017

(30) Foreign Application Priority Data

Jul. 10, 2015 (JP) ..... 2015-138681

(51) Int. Cl.
*G03G 15/08* (2006.01)
*G03G 21/00* (2006.01)

(52) U.S. Cl.
CPC ..... *G03G 21/00* (2013.01); *G03G 15/0831* (2013.01); *G03G 15/0862* (2013.01); *G03G 2215/0891* (2013.01)

(58) Field of Classification Search
CPC ..... G03G 15/0831; G03G 15/0862; G03G 21/00; G03G 2215/0891
See application file for complete search history.

(56) References Cited

U.S. PATENT DOCUMENTS 5,499,077 A * 3/1996 Endo ..... G03G 15/0886 250/577
2004/0247331 A1* 12/2004 Minagawa ..... G03G 15/0875 399/27
2006/0193643 A1* 8/2006 Takagi ..... G03G 15/0896 399/12
2006/0193644 A1* 8/2006 Takagi ..... G03G 15/553 399/12
2006/0193645 A1* 8/2006 Kishi ..... G03G 21/1896 399/12
2006/0238599 A1* 10/2006 Kishi ..... G03G 15/0877 347/140

(Continued)

FOREIGN PATENT DOCUMENTS

JP 6-16964 U 3/1994
JP 07295361 A * 11/1995

*Primary Examiner* — David Bolduc
(74) *Attorney, Agent, or Firm* — Renner, Otto, Boisselle & Sklar, LLP

(57) ABSTRACT

A developer detector includes a sensor housing portion, an optical sensor, and a cleaning portion. The sensor housing portion can be installed on a wall surface of a hopper storing a developer. The sensor housing portion includes a detection surface, and a step surface protruding a smaller amount from the wall surface than the detection surface to form a step height from the detection surface. The optical sensor is housed in the sensor housing portion and detects the developer through the detection surface. The cleaning portion moves in a moving region including a first region facing the detection surface and a second region facing the step surface and cleans the detection surface on the way of moving. The cleaning portion includes a flexible member and makes the flexible member slide on the detection surface while making the flexible member contact the detection surface under pressure in the first region.

9 Claims, 8 Drawing Sheets

(56) References Cited

U.S. PATENT DOCUMENTS

| | | | | |
|---|---|---|---|---|
| 2007/0036565 | A1* | 2/2007 | Okino | G03G 15/0862 399/27 |
| 2007/0140725 | A1* | 6/2007 | Kamimura | G03G 21/1857 399/90 |
| 2008/0124156 | A1* | 5/2008 | Tsui | G03G 15/0855 399/351 |
| 2011/0229155 | A1* | 9/2011 | Yoshii | G01F 23/185 399/27 |
| 2012/0230708 | A1* | 9/2012 | Fujita | G03G 15/0862 399/27 |
| 2014/0079415 | A1* | 3/2014 | Fukasawa | G03G 21/1814 399/27 |
| 2014/0112676 | A1* | 4/2014 | Mori | G03G 15/04045 399/49 |

* cited by examiner

DEVELOPER DETECTOR AND DEVELOPING DEVICE

CROSS REFERENCE

This Nonprovisional application claims priority under 35 U.S.C. §119(a) on Patent Application No. 2015-138681 filed in Japan on Jul. 10, 2015, the entire contents of which are hereby incorporated by reference.

BACKGROUND Oh THE INVENTION

1. Field of the Invention

This invention relates to a developer detector that detects a developer in a hopper in an image forming apparatus such as a printer, a copier, or a facsimile machine employing an electrophotographic system, and a developing device including the developer detector.

2. Description of Related Art

Some image forming apparatus employing an electrophotographic system includes a hopper provided between a cartridge and a developer container. Some hopper includes a sensor that detects a developer (this sensor is hereinafter called a "developer sensor"). The developer sensor determines whether or not a developer is dropping while the developer is added from the cartridge to the hopper, or whether or nor the upper surface of the developer in the hopper has reached a height where the developer sensor is installed.

If an optical sensor is used as the developer sensor, the optical sensor can be housed in a sensor housing portion and can detect a developer through a detection surface formed of a transparent member. Such an optical sensor is installed near a transport region or a storage region for the developer, so that the developer is likely to adhere to the detection surface provided to the sensor housing portion. Thus, to prevent reduction in accuracy of detection by the optical sensor, the detection surface should be cleaned.

If the detection surface has a planar shape, the detection surface can be cleaned by making a flexible member slide on the detection surface while making the flexible member contact the detection surface under pressure. During the sliding motion, it is preferable that the flexible member be placed in a curved state according to which a front edge portion of the flexible member contacting the detection surface is positioned behind a base edge portion of the flexible member supported by a support member in a moving direction. This can stabilize the cleaning performance of the flexible member and the performance can be maintained at a high level, compared to a case where the flexible member slides on the detection surface in an inverse curved state of the aforementioned state. However, the flexible member may be in the curved state partially or entirely inverse of the preferable curved state when sliding on the detection surface. This makes it difficult to place the flexible member in the preferable curved state again while the flexible member remains contacting the detection surface under pressure. Not placing the flexible member in the preferable curved state again and leaving the flexible member as it is causes reduction in cleaning performance of the flexible member.

According to the configuration of a known developer detector, an interval between detection surfaces in a pair facing each other is set to be wider gradually in a position closer to an exit that is an end of passage of a flexible member (see Japanese published unexamined utility model application No. 6-16964 (1994), for example). In this conventional developer detector, as the flexible member moves, the degree of curvature of the flexible member is reduced gradually in a position closer to the exit.

Meanwhile, in the developer detector described in Japanese published unexamined utility model application No. 6-16964 (1994), the flexible member does not return instantaneously from a curved state. This makes it difficult to remove a lump of a developer adhering to the flexible member or a support member. The adhesion of the lump of the developer to the flexible member or the support member reduces the performance of the flexible member in cleaning the detection surface, leading to reduction in accuracy of detection by the optical sensor.

Additionally, in forming a configuration allowing removal of a developer from a flexible member or a support member, imposing limitation for example on an angle of arrangement of a sensor housing portion relative to a moving direction of a cleaning portion inevitably causes reduction in a degree of freedom in designing the sensor housing portion and other members.

SUMMARY OF THE INVENTION

A developer detector includes a sensor housing portion, an optical sensor, and a cleaning portion. The sensor housing portion can be installed on a wall surface of a hopper storing a developer. The sensor housing portion includes a detection surface protruding more inwardly in the hopper than the wall surface in a state of being installed, and a step surface protruding a smaller amount from the wall surface than the detection surface to form a step height from the detection surface. The optical sensor is housed in the sensor housing portion and detects the developer through the detection surface. The cleaning portion moves in a moving region including a first region facing the detection surface and a second region facing the step surface and cleans the detection surface on the way of moving. The cleaning portion includes a flexible member and makes the flexible member slide on the detection surface while making the flexible member contact the detection surface under pressure in the first region.

DETAILED DESCRIPTION OF THE EMBODIMENTS

1. First Embodiment

Figure 1:
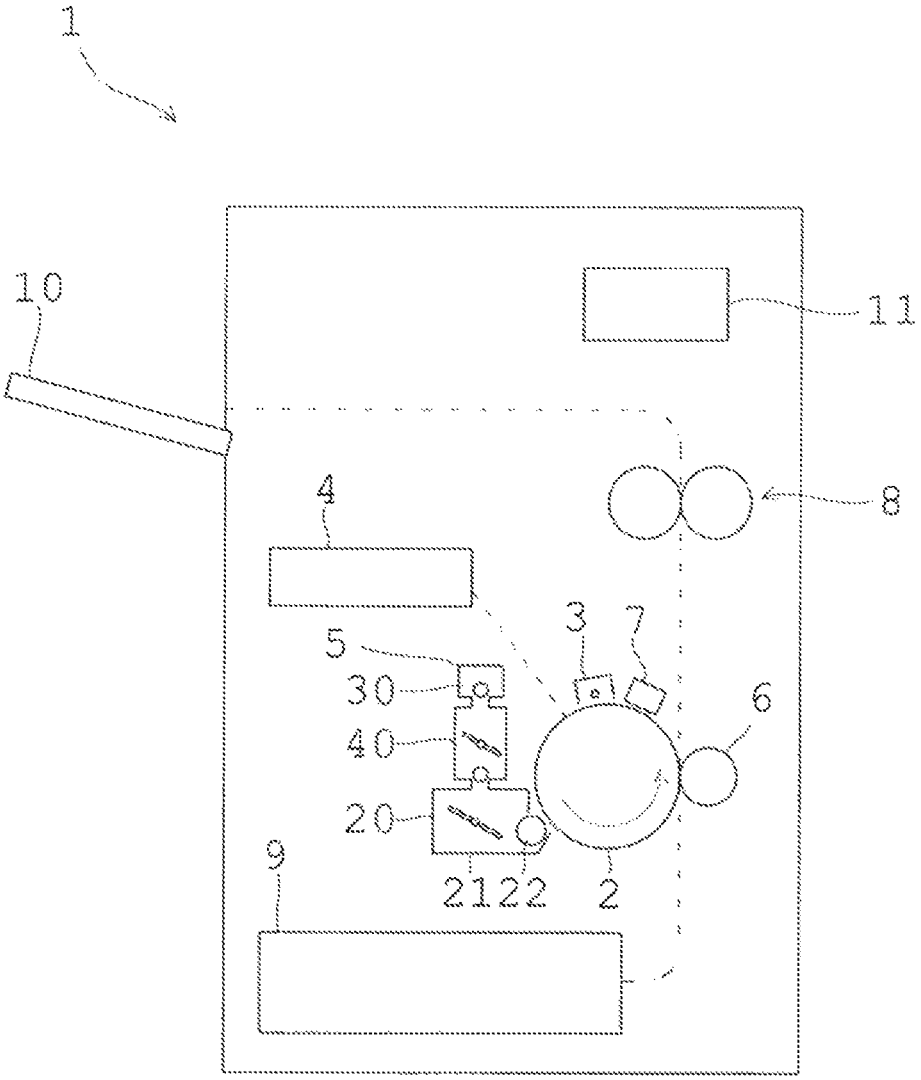
FIG. 1 shows the configuration of the outline of an image forming apparatus including a developing device.

As shown in FIG. 1, an image forming apparatus 1 includes a photoreceptor drum 2, a charging device 3, an exposure device 4, a developing device 5, a transfer roller 6, a cleaning unit 7, a fixing device 8, a feed tray 9, an output tray 10, and a controller 11. In the following description, toner is used as a developer. Even if a carrier is used in addition to the toner, the image forming apparatus 1 is still configured in the same way.

The photoreceptor drum 2 includes a photoreceptor layer on the circumferential surface thereof and rotates in one direction. The charging device 3 charges the circumferential surface of the photoreceptor drum 2 to a given potential. The exposure device 4 exposes the circumferential surface of the photoreceptor drum 2 to form an electrostatic latent image. The developing device 5 feeds toner to the circumferential surface of the photoreceptor drum 2 to develop the electrostatic latent image into a toner image.

The feed tray 9 feeds a sheet of paper to a transfer region where the photoreceptor drum 2 and the transfer roller 6 face each other. The transfer roller 6 transfers the toner image formed on the circumferential surface of the photoreceptor drum 2 onto the sheet of paper. The cleaning unit 7 recovers the toner remaining on the circumferential surface of the photoreceptor drum 2 after the toner image is transferred.

The sheet of paper on which the toner image is transferred is transported to the fixing device 8. The fixing device 8 applies heat and pressure to the sheet of paper to fuse the toner, thereby fixing the toner image to the sheet of paper. In this way, an image is formed on the sheet of paper. The sheet of paper including the resultant image is output to the output tray 10. Each device in the image forming apparatus 1 is controlled in a centralized manner by the controller 11.

Figure 2:
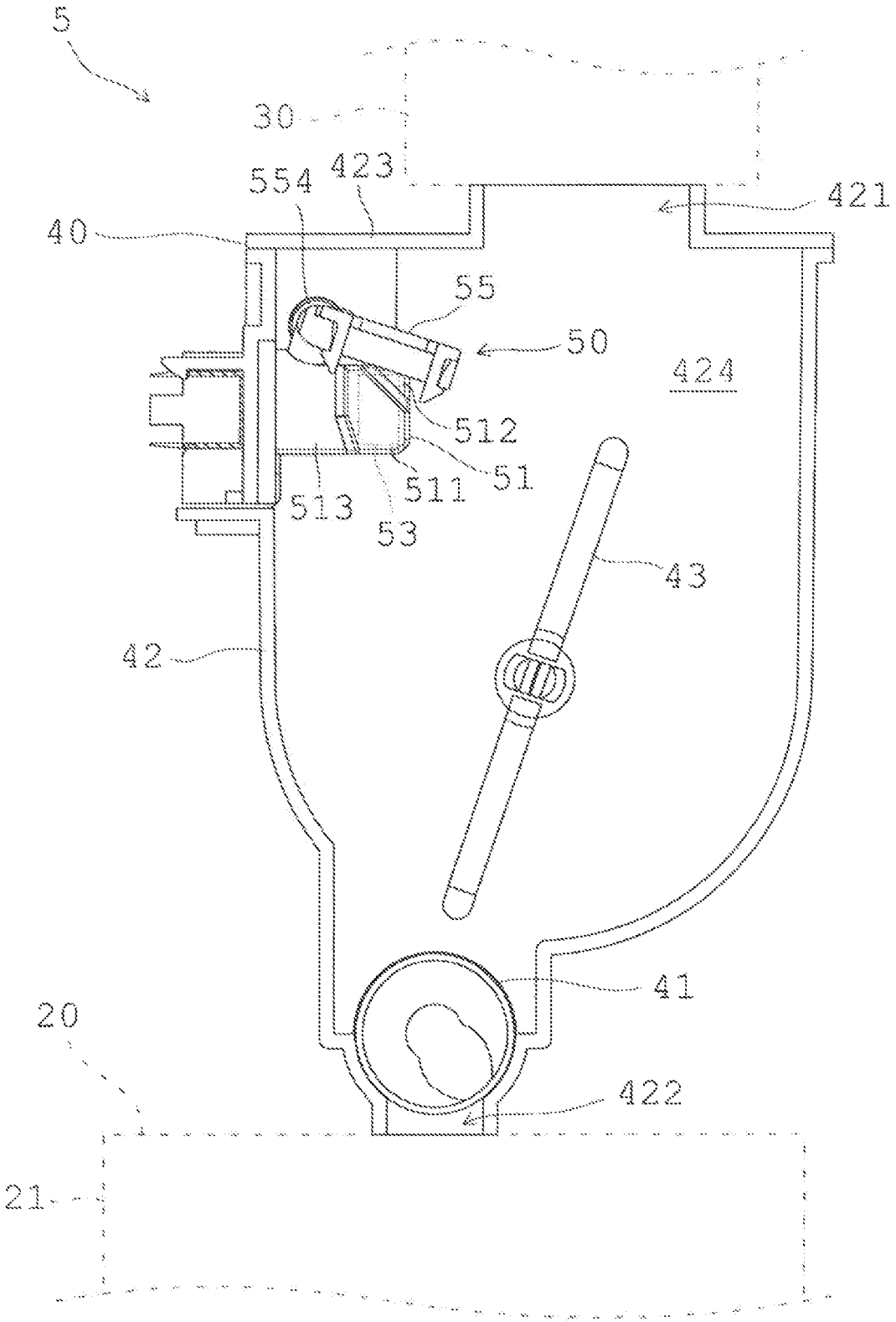
FIG. 2 is a front sectional view of a hopper included in the developing device.

As shown in FIG. 2, the developing device 5 includes a developing device body portion 20, a toner cartridge 30, and a hopper 40.

The developing device body portion 20 includes a developer container 21 and a developing roller 22 (see FIG. 1) and is arranged to face the circumferential surface of the photoreceptor drum 2. The developer container 21 stores toner as a developer. The developing device body portion 20 makes the toner in the developer container 21 bore on a circumferential surface of the developing roller 22 and makes the developing roller 22 rotate, thereby feeding the toner to the circumferential surface of the photoreceptor drum 2.

The toner cartridge 30 is attached to the body of the image forming apparatus 1 in a manner that allows the toner cartridge 30 to be detached freely. The toner cartridge 30 stores toner for replenishment. The toner cartridge 30 empty of toner is changed to a toner cartridge 30 filled with toner.

The hopper 40 is arranged between the toner cartridge 30 and the developing device body portion 20. Toner discharged from the toner cartridge 30 is stored once in the hopper 40 and then fed from the hopper 40 to the developer container 21.

If the amount of toner in the developer container 21 is reduced, the controller 11 makes a feed roller 41 of the hopper 40 rotate to feed toner from the hopper 40 to the developer container 21. If the amount of toner in the hopper 40 is reduced, the controller 11 makes a replenishment roller (not shown in the drawings) of the toner cartridge 30 rotate to add toner from the toner cartridge 30 to the hopper 40. In this way, toner to be added from the toner cartridge 30 to the developer container 21 is stored once in the hopper 40, thereby stabilizing the amount of the toner to be added to the developer container 21. Even if the toner cartridge 30 is detached, as long as toner is stored in the hopper 40, the toner can be added continuously to the developer container 21.

As shown in FIG. 2, the hopper 40 includes a hopper container 42, a stirring member 43, and a developer detector 50 in addition to the feed roller 41.

The hopper container 42 includes an upper lid 423 with a replenishment opening 421 provided at an upper end portion of the hopper container 42. The hopper container 42 further includes a discharge opening 422 formed at a lower end portion of the hopper container 42. Toner discharged from the toner cartridge 30 goes into the hopper container 42 through the replenishment opening 421 and is then stored in the hopper container 42.

The stirring member 43 is supported about a shaft in the hopper container 42 and rotates in the hopper container 42. As the stirring member 43 rotates, toner in the hopper container 42 is stirred.

The feed roller 41 is rotatably supported about a shaft in the hopper container 42 and placed in a position near the discharge opening 422. Toner in the hopper container 42 is discharged through the discharge opening 422 in a manner that depends on the amount of rotation of the feed roller 41 and then fed to the developing device body portion 20.

As shown in FIGS. 2 to 5, the developer detector 50 includes a sensor case 51 and a sensor case 52 in a pair, an optical sensor 53 and an optical sensor 54 (the optical sensor 54 is not shown In the drawings), and a cleaning portion 55. Each of the sensor cases 51 and 52 forms a sensor housing portion.

Figure 3:
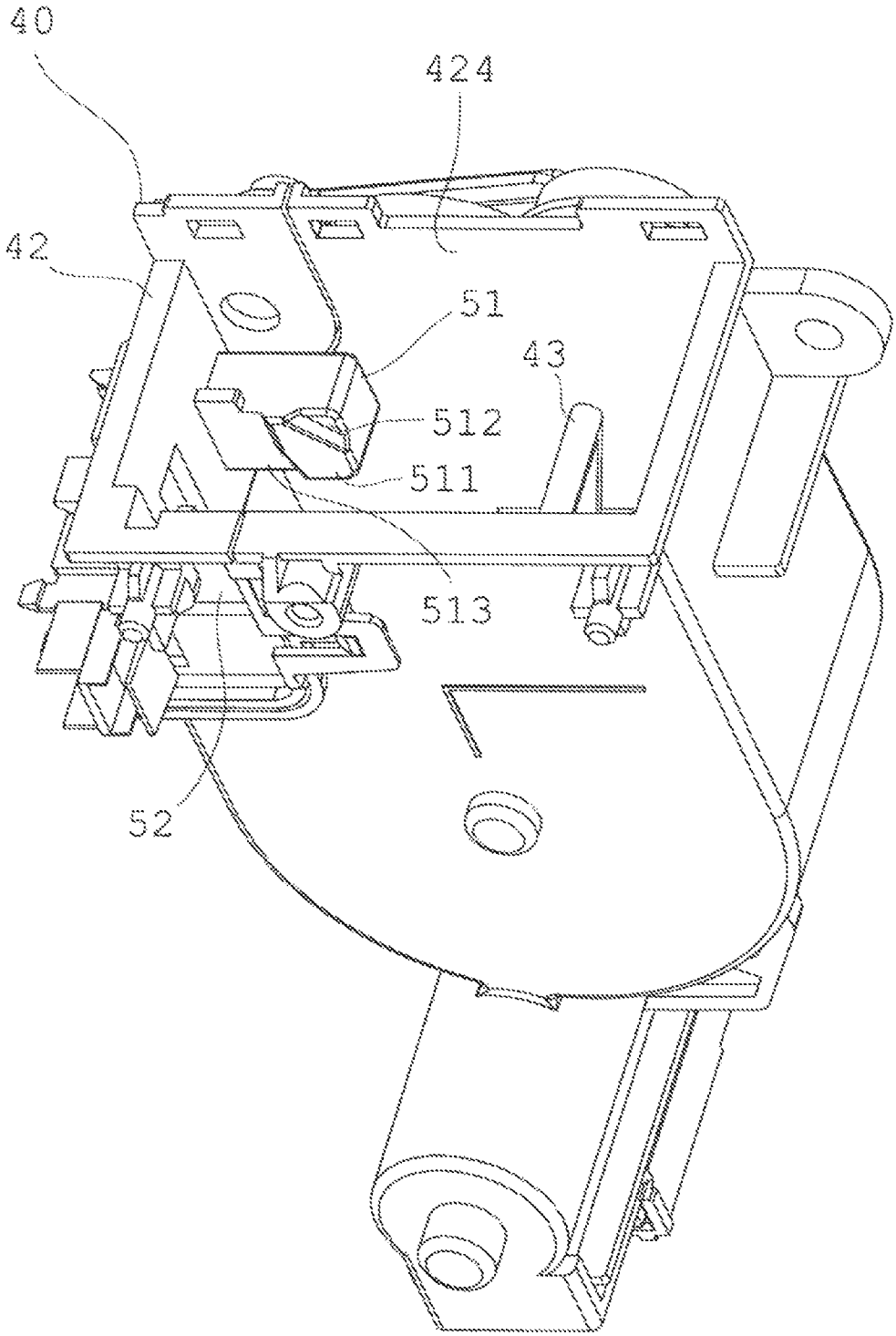
FIG. 3 is a perspective view of the hopper.
Figure 5:
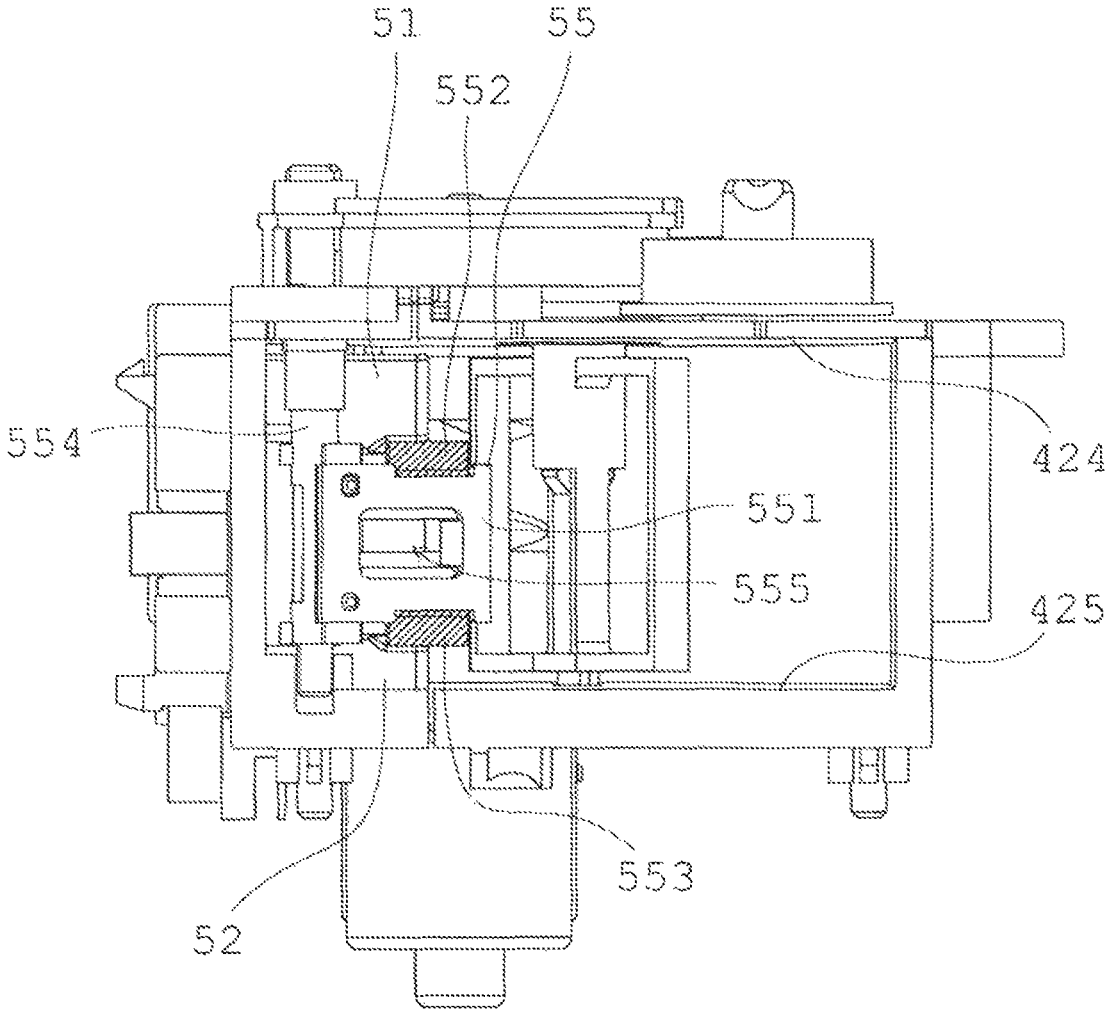
FIG. 5 is a top view of the hopper.

As shown in FIGS. 2 and 3, the sensor case 51 is provided on a side wall surface 424 of the hopper container 42 and at a given height in the hopper container 42. The sensor case 51 is formed to protrude inwardly from the side wall surface 424. As shown in FIG. 5, the sensor case 52 is provided on a side wall surface 425 of the hopper container 42 and at the above given height. The sensor case 52 is formed to protrude inwardly from the side wall surface 425. The side wall surfaces 424 and 425 are wall surfaces facing each other. Illustrations of the upper lid 423 and the cleaning portion 55 are omitted from FIG. 3.

Figure 4:
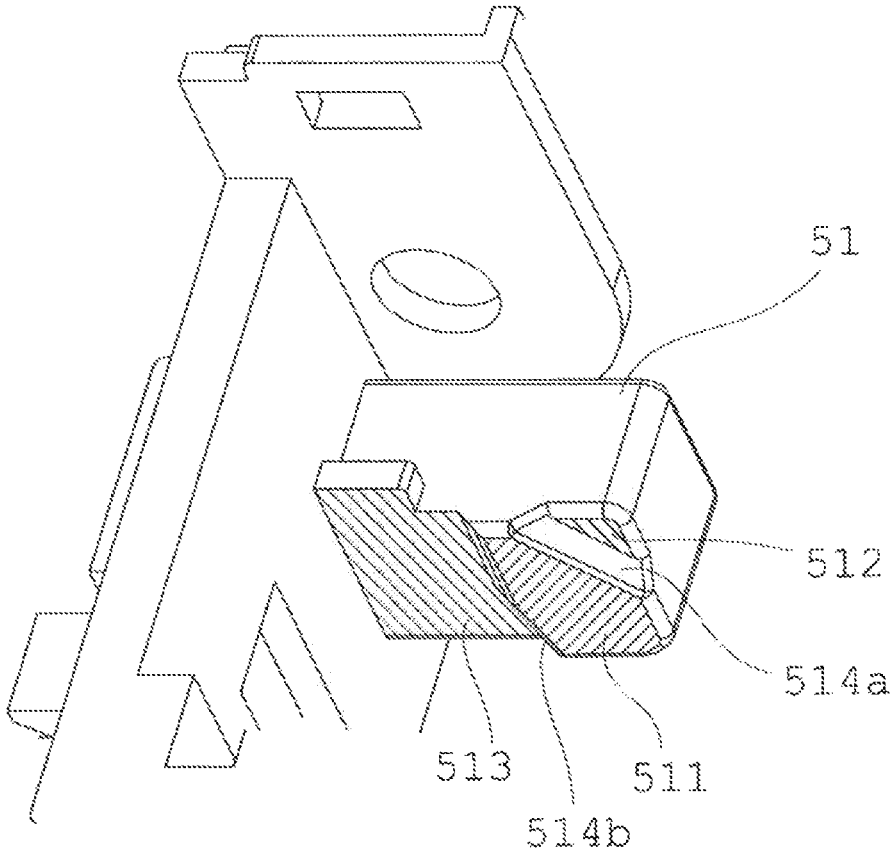
FIG. 4 is a perspective view of a part of the hopper in an enlarged manner.

As shown in FIG. 4, the sensor case 51 includes a detection surface 511, a step surface 512, and a step surface 513. In FIG. 4, all the detection surface 511 and the step surfaces 512 and 513 are hatched for the convenience of description.

The detection surface 511 is formed of a transparent member and substantially parallel to the side wail surface 424 on which the sensor case 51 is provided. The step surfaces 512 and 513 are also substantially parallel to the side wall surface 424. Each of the step surfaces 512 and 513 protrudes a smaller amount from the side well surface 424 than the detection surface 511 to form a step height 514*a* between the step surface 512 and the detection surface 511 and a step height 514*b* between the step surface 513 and the detection surface 511 (see FIGS. 4 and 7). The step surfaces 512 and 513 are provided on opposite sides of the detection surface 511 in a moving direction of the cleaning portion 55 described later (see FIG. 7).

The sensor case 52 has substantially the same shape as the sensor case 51 (or a shape bilaterally symmetric to that of the sensor case 51). The sensor cases 51 and 52 are provided on the side wall surfaces 424 and 425 respectively of the hopper container 42 facing each other in such a manner that the respective detection surfaces 511 of the sensor cases 51 and 52 face each other.

The optical sensor 53 is housed in the sensor case 51 (see FIG. 2). The optical sensor 54 is housed in the sensor case 52. In this embodiment, the optical sensor 53 is a light-emitting element and the optical sensor 54 is a lightreceiving element. As an example, the optical sensor 53 includes a sensor optical axis from 1.5 to 2.0 mm. The optical sensors 53 and 54 detect toner through the respective detection surfaces 511 of the sensor cases 51 and 52 where the optical sensors 53 and 54 are housed respectively. If the optical sensors 53 and 54 detect toner, the controller 11 can determine that the toner in the hopper container 42 has reached a given height. As shown in FIG. 2, in this embodiment, it is preferable that the developer detector 50 be arranged in a position shifted laterally along the side wail surface 424 (or 425) from a position directly below the replenishment opening 421.

Figure 6:
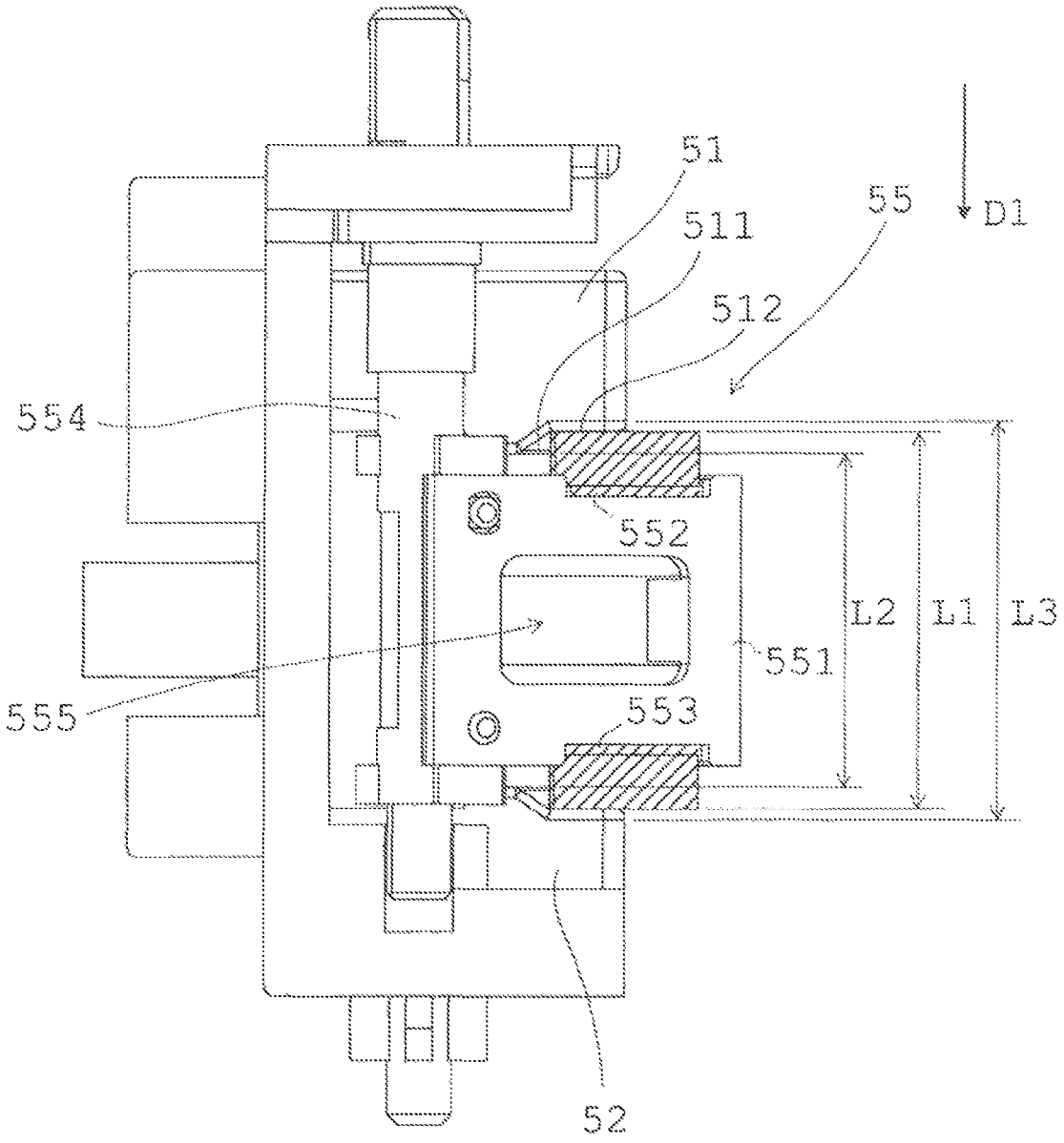
FIG. 6 is a top view of a pert of the hopper in an enlarged manner.
Figure 8:
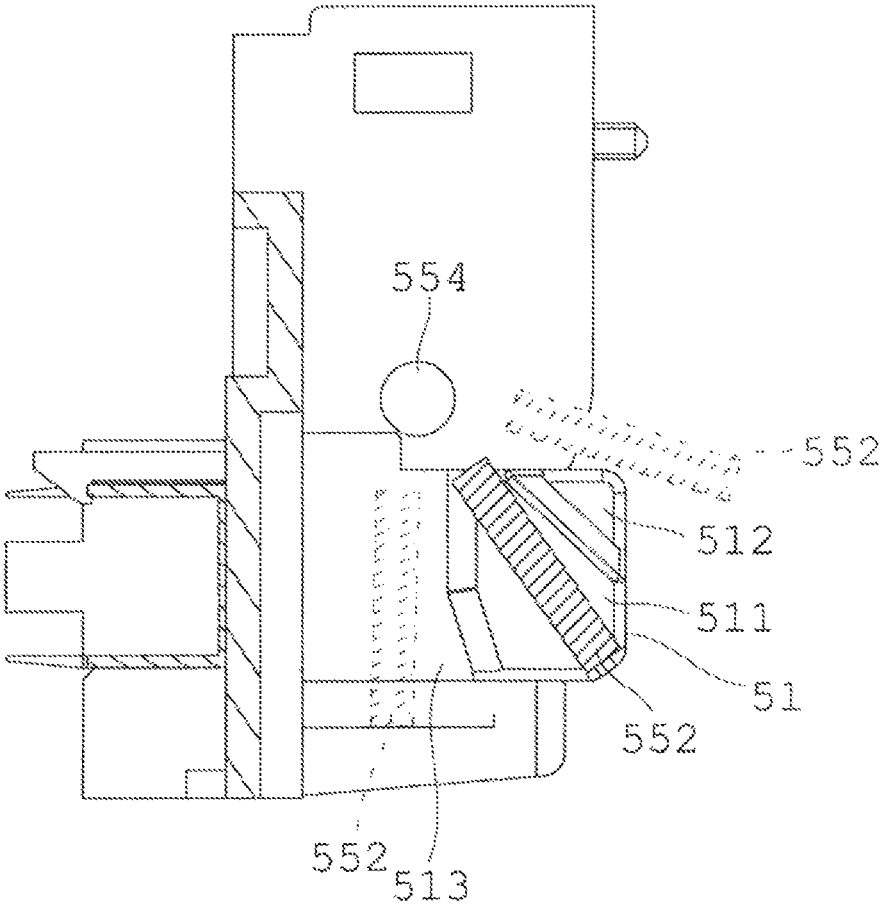
FIG. 8 schematically shows movement of a cleaning portion in a developer detector included in the developing device.

As shown in FIG. 5, the cleaning portion 55 includes a support member 551, a flexible member 552, and a flexible member 553. The cleaning portion 55 further includes a shaft portion 554 that allows the cleaning portion 55 to pivot. The shaft portion 554 extends in a direction perpendicular to the side wall surface 424. In a normal installation state of the image forming apparatus 1, the direction in which the shaft portion 554 extends is a horizontal direction. In FIGS. 5, 6, and 8, the flexible members 552 and 553 are hatched for the convenience of description.

The support member 551 is configured to pivot about the shaft portion 554. The support member 551 includes a hole portion 555 formed at the center thereof for letting toner pass through. Thus, toner having dropped to the support member 551 from above partially or entirely passes through the hole portion 555 to drop downwardly. This makes it unlikely that the toner will be deposited on the support member 551 to adhere to the support member 551.

The flexible members 552 and 553 are made of nitrile-butadiene rubber (NBR), for example. Alternatively, the flexible members 552 and 553 may be made of urethane rubber or silicon rubber. The flexible members 552 and 553 have a hardness (JIS-A hardness) set at from about 60 to about 90 degrees. This hardness is set at 60 degrees, for example.

The flexible members 552 and 553 are supported on opposite edge portions of the support member 551. More specifically, the flexible member 552 includes a base edge portion supported on an edge portion of the support member 551 closer to the side wall surface 424. The flexible member 553 includes a base edge portion supported on an edge portion of the support member 551 closer to the side wall surface 425.

The cleaning portion 55 is configured in such a manner that, while the support member 551 pivots about the shaft portion 554, a front edge portion of the flexible member 552 contacts the detection surface 511 of the sensor case 51 under pressure and a front edge portion of the flexible member 553 contacts the detection surface 511 of the sensor case 52 under pressure on the way of the pivotal motion. In this embodiment, the support member 551 is placed at the height of the detection surfaces 511 of the sensor cases 51 and 52.

As shown in FIG. 6, in a direction D1 perpendicular to the side wall surface 424, a dimension L1 between the front edge portion of the flexible member 552 and that of the flexible member 553 is larger than an interval L2 between the respective detection surfaces 511 of the sensor cases 51 and 52. In this embodiment, the dimension L1 is further set to be smaller than an interval L3 between the respective step surfaces 512 (or respective step surfaces 513) of the sensor cases 51 and 52.

Figure 7:
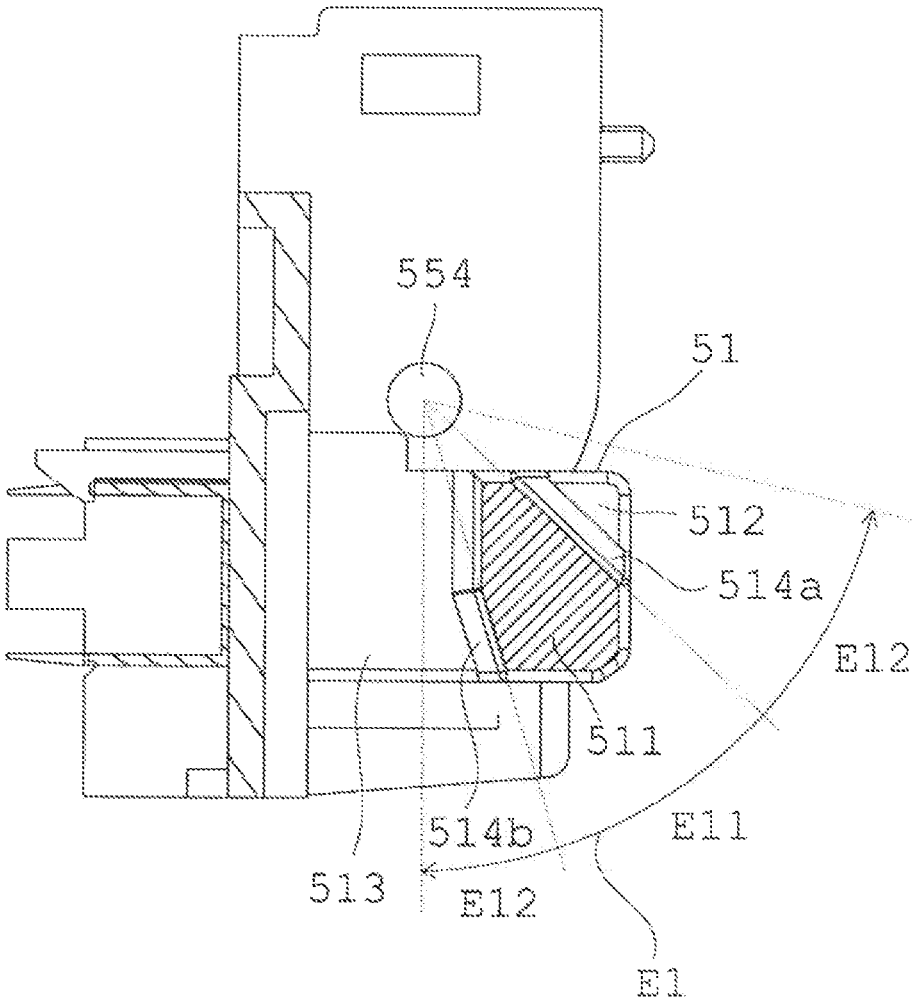
FIG. 7 is a front sectional view of a part of the hopper in an enlarged manner.

As shown in FIG. 7, the step height 514*a* formed between the detection surface 511 and the step surface 512 radially extends at least partially from the shaft portion 554. The step height 514*b* formed between the detection surface 511 and the step surface 513 radially extends at least partially from the shaft portion 554. In FIG. 7, the detection surface 511 is hatched for the convenience of description.

As shown in FIG. 8, the cleaning portion 55 moves back and forth in an arc pattern about the shaft portion 554 in a moving region E1 including a first region E11 facing the respective detection surfaces 511 of the sensor cases 51 and 52 and a second region E12 facing the respective step surfaces 512 or 513 of the sensor cases 51 and 52. Specifically, the cleaning portion 55 pivots to move in the moving region E1. According to the aforementioned configuration of the cleaning portion 55, the cleaning portion 55 makes each of the flexible members 552 and 553 contact the detection surface 511 under pressure while the cleaning portion 55 moves in the first region E11. Further, the cleaning portion 55 keeps each of the flexible members 552 and 553 from contacting the step surface 512 or 513 while the cleaning portion 55 moves in the second region E12.

Thus, while the cleaning portion 55 moves in the first region E11, each of the flexible earners 552 and 553 slides on the detection surface 511 while contacting the detection surface 511 under pressure. In this way, toner adhering to the detection surface 511 is removed. Specifically, the detection surface 511 is cleaned on the way of movement of the cleaning portion 55. It is preferable that each of the flexible members 552 and 553 be curved as follows on the detection surface 511 in terms of enhancing cleaning performance. Specifically, it is preferable that, in a moving direction (forward direction and backward direction) of each of the flexible members 552 and 553, each of the flexible members 552 and 553 be curved in such a manner that the front edge portion thereof contacting the detection surface 511 under pressure is positioned behind the base edge portion thereof supported by the support member 551.

In the hopper 40, an interval between the support member 551 and each of the step surfaces 512 and 513 is wider than an interval between the support member 551 and the detection surface 511 (see FIG. 6). Thus, each of the flexible members 552 and 553 is placed in a curved state while the cleaning portion 55 moves in the first region E11. While the cleaning portion 55 moves in the second region E12, each of the flexible members 552 and 553 is placed in an expanded state in which its flexible member is not curved because of not contacting the step surfaces 512 and 513. According to the presence of the step heights 514*a* and 514*b*, each of the flexible members 552 and 553 returns instantaneously from the curved state to the expanded state when the cleaning portion 55 moves from the first region E11 to the second region E12. As result, from the flexible member or the support member 551 can a lump of toner adhering thereto be removed.

As the cleaning portion 55 moves from the second region E12 to the first region E11, each of the flexible members 552 and 553 shifts from the expanded state to the curved state. This allows each of the flexible members 552 and 553 to slide easily in a preferable curved state on the detection surface 511, compared to a case where the cleaning portion 55 moves back and forth in the first region E11 without passing through the second region E12. The preferable curved state mentioned herein is a state according to which the front edge portion is positioned behind the base edge portion in a forward direction during movement in the forward direction, while the front edge portion is positioned behind the base edge portion in a backward direction during movement in the backward direction. Specifically, each of the flexible members 552 and 553 is unlikely to be placed in an inverse curved state of the preferable curved state (according to the inverse curved state, the front edge portion is positioned ahead of the base edge portion in a moving direction.) This makes it possible to enhance the performance of each of the flexible members 552 and 553 in cleaning the detection surface 511.

In the developer detector 50, the sensor case 51 is provided with the step surfaces 512 and 513. This provides further housing space for members such as the optical sensor 53 inside the step surfaces 512 and 513, compared to a structure where the sensor case 51 simply protrudes from the side wall surface 424. This also applies to the sensor case 52. As a result, reduction in a degree of design freedom is suppressed.

As described above, the developer detector 50 is capable of suppressing reduction in a degree of design freedom and enhancing accuracy of toner (developer) detection by enhancing performance in cleaning the detection surface 511.

The cleaning portion 55 is configured to move back and forth in the moving region E1 including the second region E12. Thus, while a direction of movement is to be changed from a forward direction on the detection surface 511 to a backward direction and while a direction of movement is to be changed from the backward direction on the detection surface 511 to the forward direction, each of the flexible members 552 and 553 passes through a region on the step surface 512 or 513. Hence, each of the flexible members 552 and 553 is placed in the expanded state once after moving in the forward direction on the detection surface 511. This allows each of the flexible members 552 and 553 to slide on the detection surface 511 in the aforementioned preferable curved state when moving in the backward direction. This also applies to a case where each of the flexible members 552 and 553 moves in the backward direction on the detection surface 511, then passes through the region on the step surface 512 or 513, and moves in the forward direction on the detection surface 511 thereafter.

Additionally, in the developer detector 50, the step surfaces 512 and 513 are provided on opposite sides of the detection surface 511 in a moving direction of the cleaning portion 55. Thus, irrespective of a direction in which each of the flexible members 552 and 553 has moved along the detection surface 511, each of the flexible members 552 and 553 returns instantaneously from its curved state to its expanded state by passing through the step surface 512 or 513. As a result, a lump of toner is removed more easily from the flexible member or the support member 551, Further, irrespective of a direction in which each of the flexible members 552 and 553 has moved along the detection surface 511, each of the flexible members 552 and 553 is placed in the expanded state once by passing through the step surface 512 or 513. This allows each of the flexible members 552 and 553 to shift to the aforementioned preferable curved state easily for next sliding motion on the detection surface 511.

Additionally, in the developer detector 50, the step surfaces 512 and 513 are configured in such a manner that the step heights 514*a* and 514*b* radially extend from the shaft portion 554. Thus, as the cleaning portion 55 pivots about the shaft portion 554, the longitudinal direction of the cleaning portion 55 extending from the shaft portion 554 becomes parallel to a direction in which each of the step height 514*a* and 514*b* extends. Hence, when the cleaning portion 55 moves between the first region E11 and the second region E12, the flexible members 552 and 553 are to contact the corresponding detection surfaces 511 at the same time and are to separate from the corresponding detection surfaces 511 at the same time. This makes it unlikely that each of the flexible members 552 and 553 partially will be placed in different curved states, so that each of the flexible members 552 and 553 as a whole is placed in the favorable curved state easily. Each of the flexible members 552 and 553 as a whole simultaneously returns instantaneously from the curved state to the expanded state, so that a lump of toner is removed more easily from the flexible member or the support member 551.

2. Second Embodiment

In the developer detector 50, the flexible member 552 may have a configuration described below and this configuration also applies to the flexible member 553. The following description proceeds while focus is placed on the flexible member 552.

The flexible member 552 may also be configured to contact the step surface 512 or 513 while the cleaning portion 55 moves in the second region 812. More specifically, the flexible member 552 is configured to contact each of the step surfaces 512 and 513 by pressing force smaller than the pressing force of the flexible member 552 of contacting the detection surface 511 acting while the cleaning portion 55 moves in the first region E11. Specifically, in this embodiment, the dimension L1 (see FIG. 6) is set to be larger than the interval L3 between the respective step surfaces 512 (or respective step surfaces 513) of the sensor cases 51 and 52.

While the cleaning portion 55 moves in the first region E11, the flexible member 552 is placed in a first curved state. While the cleaning portion 55 moves in the second region E12, the flexible member 552 is placed in a second curved state that has a radius of curvature larger than that of the first curved state (specifically, the second curved state is a gently curved state according to which a curved degree is lower.)

The step height is termed between the detection surface 511 and each of the step surfaces 512 and 513. Thus, when the cleaning portion 55 moves from the first region E11 to the second region E12, the flexible member 552 returns instantaneously from the first curved state to the second curved state (gently curved state). In this way, a lump of toner adhering to the flexible member 552 or the support member 551 can be removed therefrom.

3. Third Embodiment

In the developer detector 50, the cleaning portion 55 may also be configured to rotate in one direction. Even if the cleaning portion 55 rotates in one direction, the cleaning portion 55 still passes through the first region E11 and the second region E12 alternately. Thus, after being placed in the curved state (first curved state) on the detection surface 511, the flexible member 552 is always placed in the expanded state or the gently curved state (second curved stated) once. Then, the flexible member 552 is placed in the curved state again on the detection surface 511. This also applies to the flexible member 553.

A new embodiment can be devised by combining the respective technical features of the aforementioned embodiments.

It should be noted that the foregoing description of the embodiments is in ail aspects illustrative and not restrictive. The scope of this invention is defined by the appended claims rather than by the embodiments described above. All changes that fall within a meaning and a range equivalent to the scope of the claims are therefore intended to be embraced by the claims.

What is claimed is:

1. A developer detector comprising:

a sensor housing portion to be installed on a wall surface of a hopper storing a developer, the sensor housing portion including a detection surface protruding more inwardly in the hopper than the wail surface in a state of being installed, and a step surface protruding a smaller amount from the wall surface than the detection surface to form a step height from the detection surface;

an optical sensor housed in the sensor housing portion, the optical sensor detecting the developer through the detection surface; and a cleaning portion that moves in a moving region including a first region facing the detection surface and a second region facing the step surface and cleans the detection surface on the way of moving, the cleaning portion including a flexible member and making the flexible member slide on the detection surface while making the flexible member contact the detection surface under pressure in the first region.

2. The developer detector according to claim 1, wherein the cleaning portion makes the flexible member contact the detection surface under pressure while she cleaning portion moves in the first region, and keeps the flexible member from contacting the step surface while the cleaning portion moves in the second region.

3. The developer detector according to claim 1, wherein the cleaning portion moves back and forth in the moving region.

4. The developer detector according to claim 1, wherein the step surface is provided on each of opposite sides of the detection surface in a moving direction of the cleaning portion.

5. The developer detector according to claim 1, wherein the cleaning portion further includes a shaft portion that allows pivotal motion of the cleaning portion and makes the pivotal motion to move in the moving direction.

6. The developer detector according to claim 5, wherein the step height formed between the detection surface and the step surface extends radially from the shaft portion.

7. The developer detector according to claim 5, wherein the cleaning portion further includes a support member that pivots about the shaft portion, the flexible member is supported by the support member, and the support member includes a hole portion for letting the developer pass through.

8. The developer detector according to claim 1, wherein the sensor housing portion includes sensor housing portions provided on wall surfaces of the hopper facing each other, and the sensor housing portions are arranged in such a manner that the respective detection surfaces of the sensor housing portions face each other.

9. A developing device comprising:

a hopper that stores a developer;

a developer container replenished with the developer from the hopper; and a developer detector that detects the developer in the hopper, wherein the developer detector comprises:

a sensor housing portion installed on a wall surface of the hopper, the sensor housing portion including a detection surface protruding more inwardly in the hopper than the wall surface, and a step surface protruding a smaller amount from the wall surface than the detection surface to form a step height from the detection surface;

an optical sensor housed in the sensor housing portion, the optical sensor detecting the developer through the detection surface; and a cleaning portion that moves is a moving region including a first region facing the detection surface and a second region facing the step surface and cleans the detection surface on the way of moving, the cleaning portion including a flexible member and making the flexible member slide on the detection surface while making the flexible member contact the detection surface under pressure in the first region.

* * * * *